United States Patent [19]

Stevens et al.

[11] 4,058,862

[45] Nov. 22, 1977

[54] WATER SAFETY DEVICE

[76] Inventors: Daryl A. Stevens, 610 N. 10th St.; Russell D. Wicktor, Rte. 3, both of Princeton, Minn. 55371

[21] Appl. No.: 744,234

[22] Filed: Nov. 23, 1976

Related U.S. Application Data

[63] Continuation-in-part of Ser. No. 580,903, May 27, 1975, Pat. No. 3,992,739.

[51] Int. Cl.[2] ..... B63C 9/00

[52] U.S. Cl. ..... 9/14; 9/11 A

[58] Field of Search ..... 9/2 A, 11 A, 13, 14

[56] References Cited

U.S. PATENT DOCUMENTS

| | | | |
|---|---|---|---|
| 1,206,696 | 11/1916 | Gulbrandsen | 9/11 A |
| 2,367,835 | 1/1945 | Kreyer | 9/2 A |
| 2,748,401 | 6/1956 | Winstead | 9/11 A X |
| 3,105,981 | 10/1963 | Bennett | 9/11 A X |

*Primary Examiner*—Trygve M. Blix
*Assistant Examiner*—Sherman D. Basinger
*Attorney, Agent, or Firm*—Burd, Braddock & Bartz

[57] ABSTRACT

An inflatable water flotation device for remote rescue of a victim in peril of drowning. The device has one or more elongate, closed tubular members constructed of a flexible, air-impervious material permitting compact folding and storage of the device in a deflated configuration. Elongate tubular members are stored in a compact, water-tight case. Upon inflation by a gas, the tubular members are deployable as a unit to an elongate, generally linear, semi-rigid device, one end of which is remotely maneuverable to a distant victim. A self-contained gas supply associated with the device is operable for rapid inflation of the tubular members at time of emergency. A safety line is contiguous with the length of the device and facilitates grasping by the victim to expedite recovery of the victim.

22 Claims, 8 Drawing Figures

WATER SAFETY DEVICE

CROSS REFERENCE TO RELATED APPLICATION

This application is a continuation-in-part of U.S. application Ser. No. 580,903 filed May 27, 1975, now U.S. Pat. No. 3,992,739.

BACKGROUND OF THE INVENTION

Remote rescue of a victim in peril of drowning by a rescuer is oftentimes more expedient than attempting to reach the victim for person-to-person rescue because it is faster and furthermore, the rescuer himself is not placed in peril of drowning. Various water rescue devices are available which assist in remote rescue of a victim in peril of drowning. For example, the common ring-type life buoy having an attached rope may be thrown to the victim while an end of the rope is retained by the rescuer. Accuracy of the throw is important as, once thrown, the location of the ring buoy cannot be adjusted by the rescuer except by pulling inwardly. Many rescue devices are inflatable and, when maintained ready for emergencies, are kept in the inflated state to eliminate the time factor required for inflation. If such devices are thrown to the victim, the accuracy of the throw is again important. Various elongate sticks or poles or the like which are used to extend to a drowning victim are heavy, difficult to store and cumbersome to use. Typically, such elongate poles are rigid and do not provide any measure of flexibility.

SUMMARY OF THE INVENTION

The invention relates to an inflatable, water flotation device usable to effect the rescue of a victim in peril of drowning. The device is light, inexpensive and readily transportable. The device includes one or more elongate, inflatable tubular member which is foldable in a compact bundle in a deflated configuration for storage in a water-tight, floatable case. In the unfolded, inflated configuration, the tubular members provide an elongate, generally linear device which is semi-rigid. The device is extendable to a victim in peril of drowning. The extended end of the device is easily maneuvered at the restrained end to reach the potential victim. The device may be extended over water or ice. A safety line is contiguous with the length of the device and can be grasped by the potential victim. Means are provided on the tubular member for the rapid inflation and deployment of the device. A compressed gas cartridge communicates with the interior of the tubular members through a releasable valve assembly. To deploy the tubular members, the valve release is actuated and expanding gas flows into the tubular member and rapidly inflates it. Inflation is accomplished in a matter of seconds and the device is ready to deploy to a potential victim. The device is reusable.

In one form, the water safety device has three elongated tubular members. A gas supply means connected to one tubular member is operable to discharge gas into the tubular member to rapidly elongate the device. Means having a gas restriction orifice connects the remote end of the one tubular member to the other two tubular members so that the gas flowing through the orifice will inflate the two tubular members. The three tubular members are arranged in a triangular pattern to provide the inflated device with elongated strength whereby the device can be readily manipulated and moved to the potential victim or rescuee.

IN THE DRAWINGS

DESCRIPTION OF PREFERRED EMBODIMENTS

Figure 1:
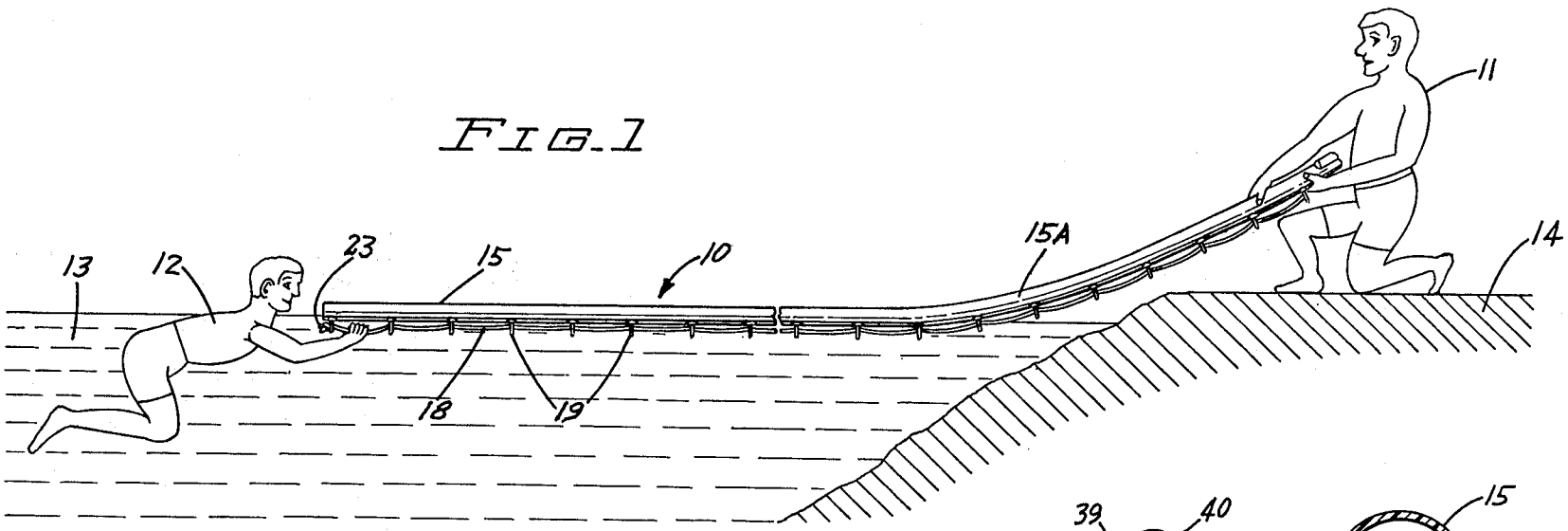
FIG. 1 is a schematic illustration of the water safety device of the invention in use with a rescuer having extended the device to an imperiled victim in the water.

Referring to the drawings, there is shown in FIG. 1 the water safety device of the invention, indicated generally at 10, in use by a rescuer person 11 to rescue an imperiled victim or rescuee 12 in a body of water 13 such as a lake, river, pond, pool or the like. Rescuer person 11 is located safely on a shore 14 and is effecting a remote rescue of victim 12. Rescue person 11 is safe from danger but is able to manipulate safely and easily the safety device 10 for grasping by imperiled victim 12 to pull victim 12 toward shore.

Safety device 10, includes an elongate, tubular member 15 closed and sealed at both ends so as to be capable of containing an expanded gas within elongated chamber 16 of tubular member 15 such as air or carbon dioxide, in the inflated configuration of FIG. 1. Tubular member 15 can be constructed of sheet-like material such as vinyl, plastic, sealed canvas, or other like material being durable, light and air-impervious. Tubular member 15 is inflatable, as shown in FIG. 1, and floats on top of the water. In the inflated configuration, tubular member 15 has a semi-rigid characteristic, having a generally linear natural axis but being bendable as shown at 15A in FIG. 1 where tubular member 15 bends upwardly toward rescuer person 11. The semi-rigid characteristic of the tubular member 15 enables remote directioning and locating of the outward end by manipulation of the inward end, akin to manipulation of a rigid pole. The outboard end is readily directable to an imperiled victim in the water or, in like manner, is readily directable over thin ice to an imperiled victim having fallen through, without endangering the rescuer. Tubular member 15 is of a suitable length to be extended outward over the water to a victim, and can be approximately 50 feet in length as most accidents or such emergencies occur within 50 feet of a shoreline, a dock, low water or other safe location from which to deploy the safety device.

A safety line 18 is coextensive with the length of tubular member 15 adapted to be grasped by imperiled victim 12 when being assisted to shore. Safety line 18 can be any variety of strong rope, cord or the like and in general will have a tensile strength greater than that of tubular member 15 thus to be able to withstand a greater tensile loading than tubular member 15. Safety line 18 is affixed relative to tubular member 15 by passing through a plurality of spaced apart eyelets 19 attached to the side wall of tubular member 15.

Figure 3:
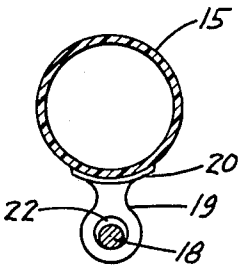
FIG. 3 is a sectional view of the safety device of FIG. 2 taken along the line 3—3 thereof.
Figure 2:
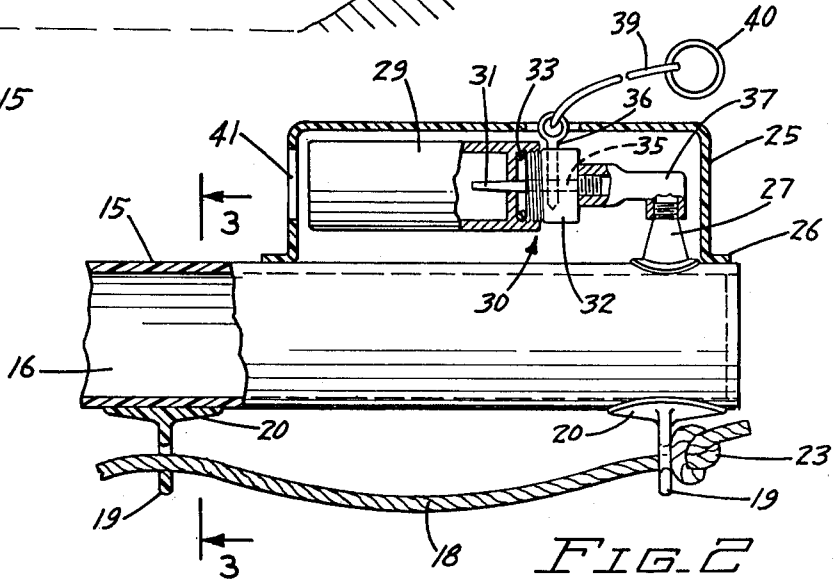
FIG. 2 is an enlarged view of the end of the safety device of FIG. 1 with portions broken away from purposes of illustration.

Referring to FIG. 3, each eyelet 19 has a base 20 suitably contoured to conform to the curvature of tubular member 15. Base 20 is affixed tubular member 15 by suitable means such as adhesive bonding. An eye 22 formed in eyelet 19 accommodates the safety line 18. As shown in FIG. 1, a plurality of the eyelets 19 are spaced apart along the length of tubular member 15 to accommodate safety line 18. As shown in FIG. 2, safety line 18 is retained in assembled relationship relative to the opposite end eyelets 19 as by having knots 23 affixed in the ends thereof. Other types of connecting structures can be used to attach line 18 to tubular member 15. Safety line 18 may comprise one, two or more cords coextensive with the length of tubular member 15.

Figure 4:
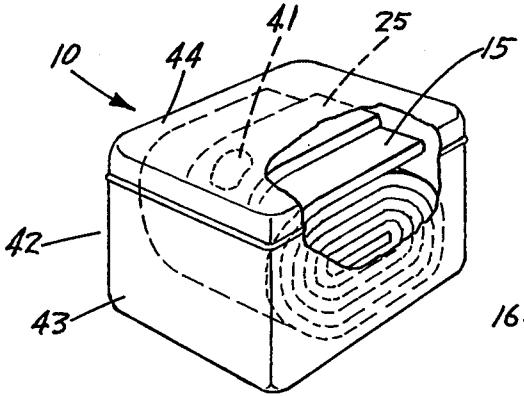
FIG. 4 is a perspective view partly broken away showing the safety device of the invention in storage configuration within a storage container.

In a deflated configuration, tubular member 15 is folded or rolled into a compact, light and readily transportable or storable bundle as shown in FIG. 4. An important feature of the safety device 10 is the capability to be quickly and simply deployed from the compact, storage configuration to the rescue configuration of FIG. 1. Deployment is accomplished within a matter of seconds thus to save valuable time upon the occurrence of an emergency.

Referring to FIG. 2, an end of tubular member 15 is provided with a pouch 25 which can be of the same material as tubular member 15 and can be bonded to tubular member 15 along the lower edges 26 of pouch 25. A self-contained compressed gas supply is stored within the confines of pouch 25. A valve stem 27 communicates with the interior of tubular member 15. A compressed gas supply cartridge 29 is operatively associated with valve stem 27 to accomplish rapid inflation of tubular member 15 upon deployment. Compressed gas cartridge 29 contains any suitable, expandable gas such as carbon dioxide, air or the like. A valve 30 is connected between compressed gas cartridge 29 and valve stem 27 for selective inflation of tubular member 15 by expanding gas derived from cartridge 29. Cartridge 29 and valve 30 can be of any of numerous suitably constructed valve and cartridge combinations commercially available. As shown, valve 30 is a needle valve having a needle 31 penetrating cartridge 30. Needle 31 extends from a valve body 32 threadably engaged at one end of cartridge 29 in sealing relationship to an O-ring 33. A linear passage 35 through valve body 32 communicates with needle 31 and is closed by a pin 36 orientated generally in perpendicular relationship to the axis of passage 35. A connector 37 extends from the outboard end of passage 35 on valve body 32 to the inlet of valve stem 27. Pin 36 is positioned with respect to the passage 35 to block the flow of expanding gas from the cartridge 29. Pin 36 is connected to a pull cord 39 having a pull ring 40 at its opposite end. Sufficient pulling force exerted upon the ring 40 or the pull cord 39 is operative to displace pin 36 from passage 35. This permits a rapid flow of expanding gas from cartridge 29 into tubular member 15 for inflation and deployment thereof. An opening 41 is provided in pouch 25 for access to the interior thereof to replace an expended compressed gas cartridge 29 for continued reuse of water safety device 10.

As shown in FIG. 4, water safety device 10 includes a compact case 42 having a four-sided housing 43 with a closed bottom and an open, accessible top closed by a removable cover 44. Case 42 is formed preferably of a floatable, weather-resistant, expanded foam plastic. Cover 44 fits in water-tight engagement with respect to the upper edges of housing 43. In the deflated, folded and bundled configuration shown in FIG. 4, tubular member 15 fits snugly within housing 43 covered by the cover 44. Additional or replacement gas cartridges may also be contained in case 42. Case 42 is compact and may be stored under the seat of a boat, near a dock or lifeguard station, or the like.

In use, water safety device 10 is maintained in a stored but prepared state of FIG. 4 in a boat, by a dock or the like. When an emergency occurs and a potential victim is imperiled in the water, tubular member 15 in the folded form is quickly removed from case 42. Pull ring 40 is engaged and pulled to initiate the expanding flow of gas from compressed gas cartridge 29 to tubular member 15. Gas rapidly exits the cartridge 29 to fill tubular member 15 in a matter of seconds. Within a short period of time, tubular member 15 is deployed in an elongate, semi-rigid configuration of FIG. 1. Tubular member 15 may be deployed in such a fashion that it expands in the direction of the imperiled victim. In any event, after expansion, the outward end of tubular member 15 is quickly maneuvered to the victim. The victim grasps tubular member 15 or safety line 18 and is pulled to safety. Tubular member 15, being inflated, offers a measure of buoyancy itself. During the rescue operation, the rescuer is not imperiled but performs the operation from a safe location.

After the rescue operation is complete, tubular member 15 is deflated by removal of expended gas cartridge 29 to allow release of gas through needle 31. The gas cartridge 29 is then replaced with a fresh cartride. In the deflated configuration, the tubular member 15 is folded and stored, again ready for use in the event of an emergency.

Referring to FIGS. 5–8, there is shown a modification of the water safety device of the invention indicated generally at 100. The water safety device 100 is used by a rescuer person to rescue an imperiled victim in a body of water, as shown in FIG. 1. Water safety device 100 includes three elongated tubular members 115, 116 and 117. The tubular members 115–117 are located in side-by-side longitudinal and parallel relationship. Tubular members 115–117 can be made of flexible sheet-like material as vinyl, plastic, canvas and other materials. The material is a durable, lightweight and air-impervious structure that can be readily rolled or folded into a compact position. Preferably, the material is a lightweight, water-repellant, flexible sheet material.

Figures 5, 6, 7, 8:
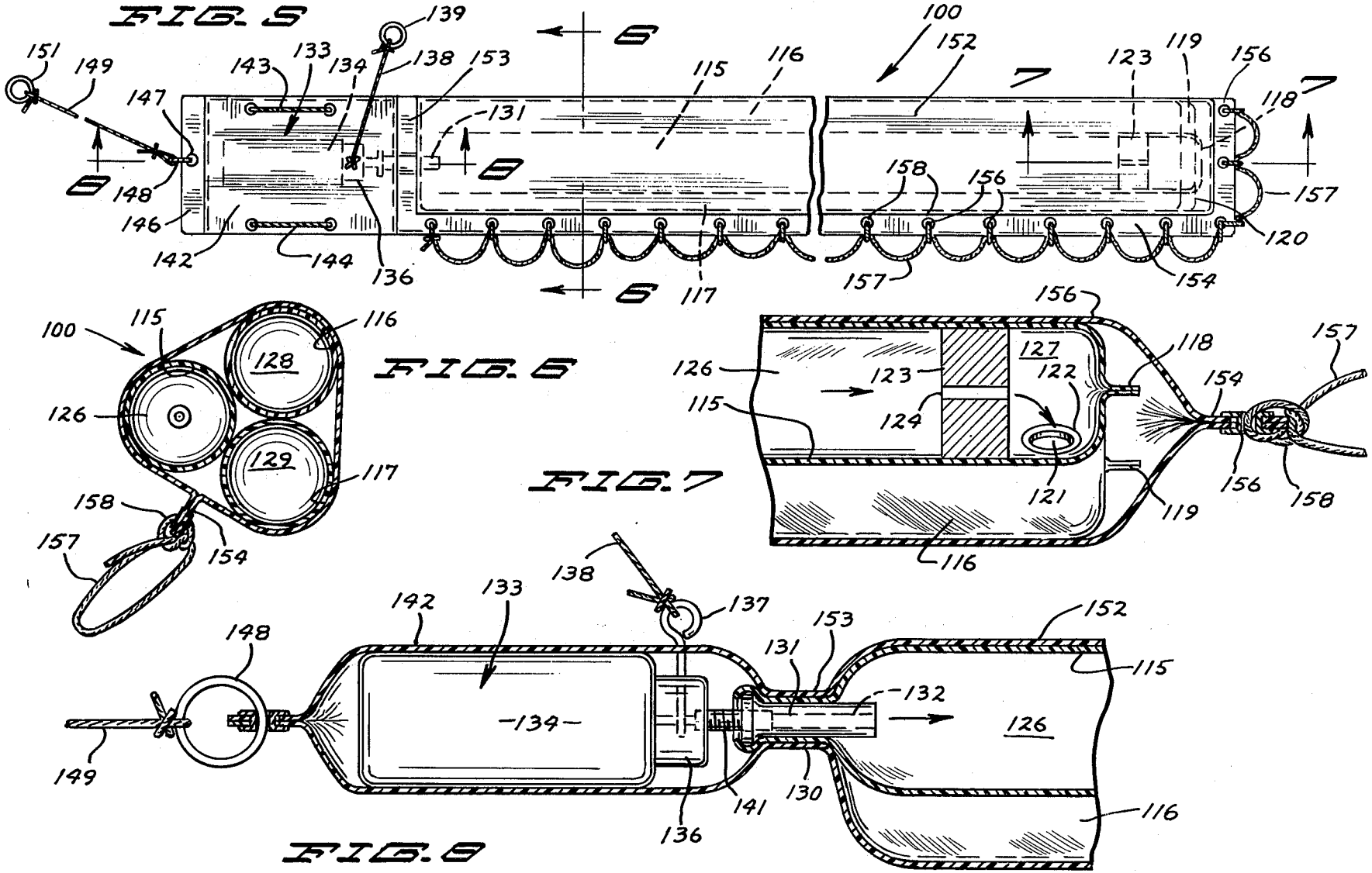
FIG. 5 is a foreshortened top plan view of a modification of the water safety device of the invention.
FIG. 6 is an enlarged sectional view taken along line 6—6 of FIG. 5.
FIG. 7 is an enlarged sectional view taken along line 7—7 of FIG. 5.
FIG. 8 is an enlarged sectional view taken along line 8—8 of FIG. 5.

As shown in FIG. 7, tubular member 115 has a sealed outer end 118. Tubular members 116 and 117 have similar sealed ends 119 and 120 respectively. A hole 121 surrounded by a grommet 122 connects the interior of tubular member 115 with the interior of tubular member 116. Grommet 122 is in clamping engagement with the adjacent wall portions of the tubular members 115 and 116. A similar grommet (not shown) having a hole or passage interconnects tubular member 115 with tubular member 117 so that air from tubular member 115 will concurrently fill tubular members 116 and 117. Other types of structures having air passages can be used to interconnect tubular member 115 to tubular members 116 and 117.

A transverse generally flat member 123 is secured to the walls of tubular member 115 adjacent the sealed end 118. Member 123 can be a seal portion of the material of the tubular member 116. Member 123 has a restricted air passage 124 connecting the elongated chamber 126 and tubular member 115 with the chamber 127 adjacent the outer end 118. Chamber 127 is in air communication with the elongated chambers 128 and 129 of tubular members 116 and 117 through chamber 127 and passages 121.

Referring to FIG. 8, the inner end of tubular member 115 has an inlet nipple 130 surrounding and secured to a cylindrical sleeve 131. Sleeve 131 has a passage 132 providing an opening to allow gas or air to flow into chamber 126.

A gas supply means indicated generally at 133 is located adjacent nipple 130. Gas supply means 133 includes a cartridge or tank 134 for storing compressed gas, such as any suitable expandable gas including carbon dioxide, air and the like. A valve 136 carrying a control pin 137 is mounted on the end of tank 134. A tubular connector 141 connects the valve 136 with sleeve 131 so that gas can flow through valve 136 into chamber 126. A pull cord 138 is connected to the eye of pin 137. A grasping ring 139, shown in FIG. 5, is secured to the free end of pull cord 138.

Gas supply means 133 is located within a pouch 142. The pouch 142 is closed with a pair of loops or cords 143 and 144 which serve as manipulating handles for the water safety device. One end of pouch 142 is closed with a transverse seam or seal 146. The center portion of seam 146 has a grommet 147 accommodating a ring 148. An elongated flexible cord 149 is tied to the ring 148. A second ring 151 is attached to the free end of cord 149. Cord 149 can have a suitable length whereby the overall effective length of the water safety device can be increased.

Three tubular members 115–117 are enclosed within a jacket or cover 152. Cover 152 can be of any suitable flexible water-resistant material, such as a sheet plastic material, canvas, rubberized fabric and the like. A transverse seam or heat-sealed portion 153 connects jacket 152 with pouch 142. Nipple 130 and cylindrical sleeve 131 extend through seam 153. Cover 152 can be secured with fasteners or heat seals to tubular members 115, 116 and 117.

Cover 152 has adjacent edges which form side and end flanges 154. A plurality of spaced holes 156 extend through the flanges 154. The material around the holes may be reinforced with grommets or additional material as shown in FIG. 7. A safety line 157 extends through each hole 156 and is attached to the flange with a knot 158. Knots 158 also hold the cover 152 about the tubular members 115–117. Line 157 is loose and forms loops between the adjacent knots 158 to provide individual grasping structure for the person being rescued.

In use, the water safety device 100 is stored and carried in a relatively small container as a bag or box. The elongated tubular members 115–117 are rolled or folded into a relatively compact space. The entire unit, including the pouch and gas supply means, can be carried in the container or box similar to the box shown in FIG. 4. The box can be a flexible bag having suitable handles so that it can be conveniently carried and stored. The bag containing the water safety device 100 is normally maintained in a stored but prepared state in the boat, dock or like convenient location. When an emergency occurs and a potential victim is imperiled in the water or on thin ice or in a hole in thin ice, the water safety device is quickly removed from its container. The rescuer pulls the pull cord 138 thereby opening the valve 136. The compressed gas in the tank 134 flows through valve 136 and sleeve 131 into the chamber of tubular member 115. Tubular member 115 is initially and rapidly expanded so that the water safety device quickly reaches its full length. The full length can be 50 or more feet. The passage 124 in member 123 functions as an air restriction orifice limiting the flow of air into the chamber 127. The tubular members 116 and 117 are inflated after the tube 115 is expanded and under pressure. The secondary tubular members 116 and 117 provide the water safety device with lateral strength and minimize the bending of the safety device. This permits the rescuer to easily manipulate the device on the surface of the water or ice. The water safety device then can be quickly maneuvered to the victim during the time that the tubular members 116 and 117 are inflated. The victim grasps the cord 157 or the portion of the safety device adjacent the victim. The operator pulls the device 100 and the victim to safety. Tubular members 115, 116 and 117 being inflated serve as a life preserver since it floats on the water. The rescuer, being on shore or standing on solid ground, is not imperiled so he can quickly perform the rescue operation from a safe location.

After the rescue operation is completed, tank 134 is removed so that tubular members 115, 116 and 117 are deflated. A new tank is then secured to the connector 141. The jacket 152 containing the tubular members 115–117 is dried and either folded or rolled into a compact position and stored in the container.

While there has been shown and described preferred embodiments of the water safety device of the invention, it is understood that changes in materials, length and parts may be made by those skilled in the art without departing from the invention. For example, the three tubular members 115, 116, 117 can be made with the cover 152. Cover 152 can be the outside sheet member of the tubular members. The inside sheet member can be longitudinally secured, as a heat seal, to the outside sheet member to form the three tubular members. The heat seal at the outer end of the first tubular member 115 can have a restricted passage allowing slow flow of gas to the tubular members 116 and 117. Also, the device 100 can have more than three tubular members. The invention is defined in the following claims.

The embodiments of the invention in which an exclusive property or privilege is claimed are defined as follows:

1. A safety device to enable a rescuer person to lend assistance to a remote imperiled victim comprising: elongate tubular means inflatable to form a substantially linear semi-rigid elongate, floatable unit having a first end that, when inflated, can be maneuvered toward an imperiled victim, and a second end that can be manipulated by a rescuer person for maneuvering the first end, and deflatable for folding into a compact bundle, said tubular means having at least a first tubular member and a second tubular member, and means having a restricted orifice connecting the first tubular member with the second tubular member to allow gas to flow from the first tubular member to the second tubular member to inflate the second tubular member after the first tubular member has been inflated and elongated by gas, gas supply means for storing a supply of gas, and releasable valve means connecting the gas supply means with the first tubular member and operable for selective rapid release of gas from the gas supply means to the first tubular member, said means having a restricted orifice defining an orifice of a size to restrict flow of gas from the first tubular member to the second tubular member such that rapid release of gas from the gas supply means first inflates the first tubular member to a semi-rigid elongate shape and then inflates the second tubular member.

2. The safety device of claim 1 including: safety line means coextensive with the length of said tubular means and means for attaching the safety line means to the tubular means.

3. The safety device of claim 2 wherein: the means for attaching the line means to the tubular means includes a plurality of eyelets spaced apart along the length of said elongate tubular means, each eyelet having an eye, said line means being threaded through the eyes of said eyelets.

4. The safety device of claim 1 including: a pouch located on said tubular means, said pouch containing said gas supply means and said valve means.

5. The safety device of claim 4 including: pull cord means associated with said valve means to release said valve means and permit flow of gas into the first tubular member.

6. The water safety device of claim 1 including: a cover surrounding the first and second tubular members, and means holding the cover in assembled relation with said tubular members.

7. The water safety device of claim 6 wherein: the means for holding the cover in assembled relation with said members includes a line secured to said cover, said line having a plurality of loops.

8. The safety device of claim 1 wherein: said tubular means has a first tubular member, a second tubular member and a third tubular member, said first tubular member having means including a restricted orifice connecting the first tubular member with the second and third tubular members to allow gas to flow from the first tubular member to the second and third tubular members, said gas inflating and elongating the second and third tubular members after the first tubular member has been inflated and elongated by gas from said gas supply means.

9. The safety device of claim 8 wherein: said tubular means includes a cover surrounding the first, second and third tubular members and means secured to the cover to hold the cover in assembled relation with said tubular member.

10. The water safety device of claim 9 wherein: the means for holding the cover in assembled relation with said members includes a line secured to said cover, said line having a plurality of loops.

11. The safety device of claim 1 wherein: said gas supply means includes a container for storing compressed gas.

12. The safety device of claim 1 wherein: said gas supply means includes a cartridge of compressed gas connected to the releasable valve means, said valve means having a movable member, movable to a position to permit release of gas from the cartridge to inflate the first tubular member with gas.

13. The safety device of claim 12 including: a third tubular member located adjacent the second tubular member, said first tubular member being connected to the third tubular member to allow gas to flow from the first tubular member to the third tubular member to inflate and elongate a third tubular member after the first tubular member has been inflated and elongated by gas.

14. A safety device comprising:

elongate tubular means inflatable to form a substantially linear semi-rigid elongate, floatable unit, and deflatable for folding into a compact bundle, said tubular means having a first tubular member, a second tubular member, and a third tubular member, and means having a restricted orifice connecting the first tubular member with the second tubular member to allow gas to flow from the first tubular member to the second tubular member to inflate the second tubular member after the first tubular member has been inflated, said third tubular member located adjacent the second tubular member, said first tubular member being connected to the third tubular member to allow gas to flow from the first tubular member to the third tubular member to inflate the third tubular member after the first tubular member has been inflated and elongated by gas, said first, second and third tubular members when inflated and elongated, being arranged in a triangular pattern with each member having a portion in engagement with each other, gas supply means for storing a supply of gas, and releasable valve means connecting the gas supply means with the first tubular member and operable for selective release of gas from the gas supply means to the first tubular member for first inflating the first tubular member to a semi-rigid elongate shape and then inflating the second and third tubular members.

15. The safety device of claim 14 including: a cover surrounding the first, second and third tubular members, and means secured to the cover and holding the cover in assembled relation with said first, second and third tubular members.

16. The safety device of claim 15 wherein: the means for holding the cover in assembled relation with said members includes a line secured to said cover, said line having a plurality of loops.

17. A safety device to enable remote rescue of an imperiled victim comprising: elongate tubular means inflatable to form a substantially linear semi-rigid elongate floatable unit having a first end that, when inflated, can be maneuvered toward an imperiled victim, and a second end that can be manipulated by a rescuer person for maneuvering the first end, said tubular means being deflatable for folding into a compact bundle, said tubular means having a plurality of elongatable tubular members, cover means surrounding said tubular members, gas supply means for storing a supply of gas, releasable valve means for selective rapid release of gas from the gas supply means to a first of the tubular members for inflating said tubular members to form a semi-rigid elongated shape, and means interconnecting the first tubular member with the other tubular members and restricting flow of gas from the first tubular member to the other tubular members such that upon release of gas from the gas supply means, the first tubular member is rapidly inflated and then the remaining tubular members are inflated.

18. The safety device of claim 17 including: safety line means coextensive with the length of the tubular means, said line means being attached to said cover means.

19. The safety device of claim 18 wherein: said cover has a plurality of linearly spacing openings, said line means being extended through said openings and secured to said cover means, said line means having a plurality of loops.

20. The safety device of claim 17 including: a pouch secured to said cover means, said pouch containing a chamber for storing said gas supply means and said valve means.

21. The safety device of claim 17 including: pull cord, pull cord means associated with said valve means to release valve means and permit the flow of gas from the gas supply means to at least one of the tubular members.

22. The safety device of claim 17 wherein: said remaining tubular members comprise second and third tubular members.

* * * * *

UNITED STATES PATENT AND TRADEMARK OFFICE

CERTIFICATE OF CORRECTION

PATENT NO. : 4,058,862

DATED : November 22, 1977

INVENTOR(S) : Daryl A. Stevens, et al.

It is certified that error appears in the above-identified patent and that said Letters Patent are hereby corrected as shown below:

Column 4, line 36, "cartride" should be -- cartridge --.

Column 9, line 2, "spacing" should be -- spaced --.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*